United States Patent [19]

Hayashi

[11] Patent Number: 4,572,115

[45] Date of Patent: Feb. 25, 1986

[54] PARTS-ARRANGEMENT IN BOILING LIQUID COOLING SYSTEM

[75] Inventor: Yoshimasa Hayashi, Kamakura City, Japan

[73] Assignee: Nissan Motor Co., Ltd., Yokohama, Japan

[21] Appl. No.: 698,397

[22] Filed: Feb. 5, 1985

[30] Foreign Application Priority Data

Feb. 23, 1984 [JP] Japan ..... 59-32995

[51] Int. Cl.[4] ..... F01P 3/22

[52] U.S. Cl. ..... 123/41.21; 123/41.27

[58] Field of Search ..... 123/41.08, 41.09, 41.1, 123/41.2, 41.21, 41.25, 41.26, 41.27, 41.15, 41.01

[56] References Cited

U.S. PATENT DOCUMENTS

| | | | |
|---|---|---|---|
| 1,346,331 | 7/1920 | Muir | 123/41.21 |
| 1,558,009 | 10/1925 | Giesler | 123/41.21 |
| 1,643,510 | 9/1927 | Muir | 123/41.08 |
| 1,676,961 | 7/1928 | Muir | 123/41.08 |
| 1,891,480 | 12/1932 | Ross | 123/41.08 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to counter cold weather, so-called "cold weather easily affected parts" of the boiling liquid cooling system are located close to the engine which is a heat generator. With this arrangement, normal operation of the cooling system is achieved in a short time after start of the engine under cold condition.

6 Claims, 3 Drawing Figures

PARTS-ARRANGEMENT IN BOILING LIQUID COOLING SYSTEM

BACKGROUND OF THE INVENTION

1. Field of the Invention

The present invention relates in general to an engine cooling system of the type wherein the coolant is boiled, so as to make use of the latent heat of vaporization thereof, and coolant vapor used as vehicle for removing heat from the engine, and more particularly to an improved parts-arrangement therefor.

2. Description of the Prior Art

Hitherto, a so-called "boiling liquid cooling system" (viz., evaporative cooling system) has been proposed for achieving cooling of a combustion engine, such as internal combustion engine. This type cooling system basically features an arrangement wherein a liquid coolant (for example, water or a mixture of water and antifreeze or the like) in the coolant jacket of the engine is permitted to boil and the gaseous coolant thus produced is passed out to an air-cooled heat exchanger or radiator where the gaseous coolant is cooled or liquefied and then recirculated back into the coolant jacket of the engine. Due to the effective heat exchange carried out between the gaseous coolant in the radiator and the atmosphere surrounding the radiator, the cooling system exhibits a very high performance.

However, as will become apparent hereinafter, some of the cooling systems of the type as mentioned hereinabove have not taken any measure to counter cold weather. Thus, in cold season, they sometimes induce abnormal or incomplete operation thereof particularly at warm-up stage of the engine due to freezing of the coolant in the system.

SUMMARY OF THE INVENTION

It is therefore an essential object of the present invention to provide an improved parts-arrangement in a boiling liquid cooling system for use with a combustion engine or the like, wherein the coolant is boiled and the vapor thus produced is used as a heat transfer medium, which can induce in a short time the normal operation of the cooling system even when the cooling system has been left in a cold condition with the coolant freezed therein.

According to the present invention, there is provided an improved parts-arrangement in a boiling liquid cooling system for an engine, the arrangement comprising means defining in the engine a coolant jacket into which coolant is introduced in liquid state through an inlet port formed in the engine and from which coolant is discharged in gaseous state through an outlet port formed in the engine, a radiator into which gaseous coolant from the outlet port is introduced to be liquefied, a separate coolant reservoir into which the liquefied coolant from the radiator is introduced, an electric pump by which the liquid coolant in the reservoir is pumped to the coolant jacket through the inlet port of the coolant jacket, a conduit connecting the radiator, the separate coolant reservoir and the electric pump to form a coolant circulation circuit which extends between the inlet and outlet ports of the coolant jacket, and at least one electromagnetic valve associated with the coolant circulation circuit to control flow of the coolant in the circuit, wherein the separate coolant reservoir, the electric pump and the electromagnetic valve are positioned close to the engine proper so as to effectively absorb heat generated by the engine.

BRIEF DESCRIPTION OF THE DRAWINGS

Other objects and advantages of the present invention will become apparent from the following description when taken in conjunction with the accompanying drawings, in which.

DESCRIPTION OF PRIOR PROPOSED BOILING LIQUID COOLING SYSTEM

Figure 1:
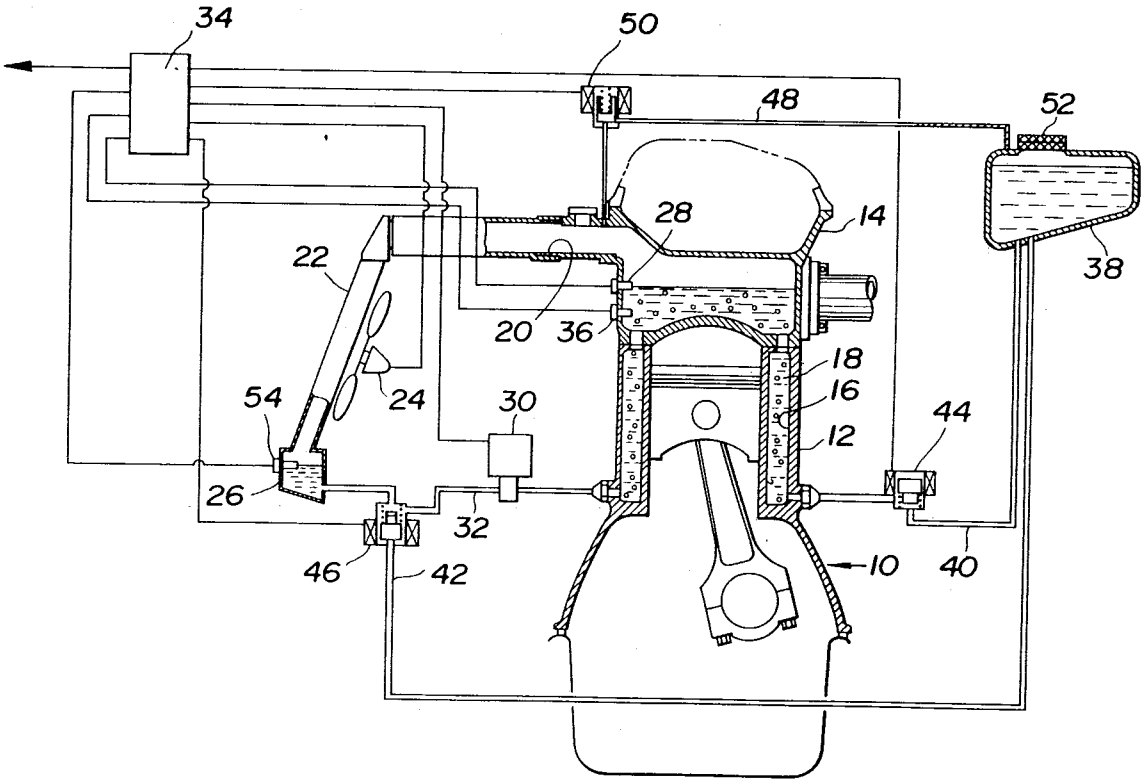
FIG. 1 is a schematical illustration of a boiling liquid cooling system which has been prior proposed.

Prior to describing in detail the invention, a prior proposed boiling liquid cooling system will be outlined with reference to FIG. 1 because the present invention is closely associated with the system as will become clear as the description proceeds.

In FIG. 1, there is schematically shown the boiling liquid cooling system practically applied to an internal combustion engine, which is substantially disclosed in Japanese Patent Application No. 58-228146 filed Dec. 2, 1983 in the name of Yoshinori HIRANO. The engine is generally designated by numeral 10 which includes a cylinder block 12 on which a cylinder head 14 is detachably secured. The cylinder head 14 and the cylinder block 12 include suitable cavities which define a coolant jacket 16 about the heated portions of the cylinder head and block. Contained in the coolant jacket 16 is cooling liquid (coolant) 18 which, under normal operation of the system, sufficiently covers the walls of the combustion chambers while maintaining the upper portion of the coolant jacket 16 empty of the liquid coolant, as shown. The liquid coolant 18 boils and evaporates when heated sufficiently by combustion heat of the engine 10, so that under operation of the engine, the upper portion of the jacket 16 is filled with coolant vapor.

Fluidly communicating with a vapor discharge port 20 of the cylinder head 14 is a radiator or heat exchanger 22. It is to be noted that the interior of this radiator 22 is maintained empty of liquid coolant during normal engine operation so as to maximize the surface area available for condensing the coolant vapor (via heat exchange with the ambient atmosphere) and that the cooling system as a whole (viz., the system encompassed by the coolant jacket, radiator and conducting interconnecting the same) is hermetically closed when the engine is warmed-up and running. These features will become clearer as the description proceeds.

Located adjacent the radiator 22 is an electrically driven fan 24 which, upon energization thereof, produces air flow passing through the radiator 22 to promote the condensation function of the same. Defined at the bottom of the radiator 22 is a small collection reservoir or lower tank 26 into which the coolant liquefied by the radiator 22 pours.

Disposed in the coolant jacket 16 of the engine 10 is a liquid level sensor 28 which detects whether the level of the liquid coolant in the coolant jacket 16 is at a predetermined level or not. That is, when, due to the continuous coolant evaporation in the jacket 16, the coolant level lowers to the predetermined level, the signal issued by the sensor 28 brings about energization of an electrically drivent pump 30 which is disposed in a return passage 32 which extends from the lower tank 26 of the radiator 22 to a lower portion of the coolant jacket 16 of the engine 10. Particularly, the operation of the pump 30 is controlled by a control unit 34 as is described in the afore-mentioned prior filed U.S. Patent Application. With this, the coolant level in the coolant jacket 16 is kept substantially at the predetermined level during normal operation of the engine 10.

A temperature sensor 36 is disposed also in the coolant jacket 16 in order to detect the temperature of the coolant therein. Receiving signals from the temperature sensor 36 and the other sensors (not shown), such as, engine rotation speed sensor, accelerator pedal angle sensor and fuel supply rate sensor, the control unit 34 controls operation of the electric fan 24 so as to allow the engine proper 10 to have an optimum temperature in accordance with the operation modes of the engine.

Under operation of the cooling system, the system as a whole is hermetically closed, so that changing the pressure in the system induces variation in the boiling point of the liquid coolant contained therein. When, for example, the engine 10 is under low load condition wherein heat generated by the engine 10 is relatively small, the control unit 34 controls the electric fan 24 to produce a less amount of air flow per unit time (in practice, the control unit 34 stops the fan 24) to lower the condensation function of the radiator 22. With this operation, the pressure in the system becomes higher than the atmospheric value increasing the boiling point of the liquid coolant in the system to a certain value, so that the temperature of the coolant in the coolant jacket 16 can be kept at relatively high degree (for example 120° C.) thereby achieving reduction in thermal loss of the engine 10.

When, on the contrary, the engine is under high load condition wherein heat generated by the engine 10 is great, the control unit 34 controls the electric fan 24 to produce a greater amount of air flow per unit time (in practice, the control unit 34 continues energization of the fan 24) to promote the condensation function of the radiator 22. With this, the pressure in the system becomes lower than the atmospheric value lowering the boiling point of the coolant in the system, so that the temperature of the coolant in the coolant jacket 16 is kept at relatively low level (for example 90° C.) thereby achieving appropriate cooling of the engine.

Since the latent heat of the coolant 18 is considerably high and the heat radiation of the coolant vapor at the radiator 22 is sufficiently high, cooling of the engine 10 can be effectively achieved with a small amount of liquid coolant. Furthermore, for the reasons as mentioned hereinabove, the temperature control of the engine 10 can be effected in accordance with the operation modes of the engine with quick response.

In order to deal with undesirable negative pressure in the system which might occur when, after stop of the engine, the temperature of the liquid coolant lowers to the atmospheric degree (for example 20° C. to 30° C.), the following measure is employed. (That is, lowering of the coolant temperature would promote liquefaction of the coolant vapor in the system and thus the pressure therein is reduced considerably).

A reservoir tank 38 is provided which is fluidly communicated with the coolant jacket 16 of the engine 10 through conduits 40 and 42. Electromagnetic valves 44 and 46 are respectively disposed in the conduits 40 and 42. The valve 46 is located at the position where the conduit 42 is joined to the return conduit 32, as shown. The control unit 34 functions so that, upon stop of the engine 10, it controls the valves 44 and 46 to open their associated conduits 40 and 42 (the passage from the reservoir tank 38 to the coolant jacket 38 through the valve 46) thereby causing the additional liquid coolant in the reservoir tank 38 to be forcedly fed to the coolant jacket 16 through the open conduits 40 and 42 by the force created by the pressure difference between the interior of the system and the atmosphere. With this, the negative pressure in the system disappears.

In order to deal with undesirable air-contamination in the system which might occur when, due to lowering in pressure in the system, atmospheric air invades the coolant jacket 16 of the engine 10, the following measure is also employed.

A conduit 48 extends from the vapor discharge port 20 of the cylinder head 14 to the reservoir tank 38, and an electromagnetic valve 50 is disposed in the conduit 48. The control unit 34 functions so that, upon starting of the engine, it controls the valves 50 and 46 to open their associated conduits 48 and 42 (the passage from the reservoir tank 38 to the coolant jacket 18 through the valve 46) and energizes the electric pump 30. With this, the additional liquid coolant in the reservoir tank 38 is forced to flow down to the coolant jacket 16 through the conduit 42 while urging the contaminating air in the jacket 16 toward the reservoir tank 38 through the conduit 48. The contaminating air thus introduced into the reservoir tank 38 is then discharged into the atmosphere through an air permeable cap 52 of the tank 38. This air purging operation is continued until the entire of the coolant jacket 16 is filled with the liquid coolant. During this operation, the valve 44 is kept closed.

When, with the contaminating air thus discharged, the temperature of the liquid coolant in the coolant jacket 16 increases to a certain degree, the coolant 18 in the coolant jacket 16 starts boiling. Upon this, the valve 44 in the conduit 40 is opened, so that the coolant in the jacket 16 is obliged to flow back to the reservoir tank 38 through the conduit 40 by the pressure created in the jacket 16. When the level of the coolant in the coolant jacket 16 lowers to the level determined by the level sensor 28, the valve 44 is closed thereby shutting off the conduit 40. During this, the electric pump 30 is kept energized thereby feeding the liquid coolant in the lower tank 26 of the radiator 22 to the coolant jacket 16. However, when the coolant level in the lower tank 26 lowers to a level determined by another level sensor 54 disposed in the lower tank 26, the coolant feeding by the pump 30 stops.

With the arrangement and operation as described hereinabove, the boiling liquid cooling system can exhibit its excellent performance throughout every operation modes of the engine 10.

DRAWBACKS ENCOUNTERED IN THE PRIOR PROPOSED COOLING SYSTEM

However, the boiling liquid cooling system of the type as mentioned above has the following drawback originating from the inherent parts-arrangement of the system. That is, in cold seasons, it sometimes occurs that, due to temperature drop of atmosphere, the coolant (even when it contains antifreeze) is freezed to show a sherbet-like state. Under this condition, it is impossible or at least difficult to carry out desired cooling operation of the system due to the deteriorated movability of the sherbet-like coolant. In particular, the coolant in the radiator 22 (which is highly cooled in such condition) tends to completely freeze causing a blocking against the coolant flow in the radiator 22 and thus in the cooling system. If, under this blocked condition, the engine is subjected to high load operation, the internal pressure in the cooling system becomes abnormally high and thus the engine becomes over-heated. As the boiling liquid cooling system uses only a small amount of liquid coolant, the "coolant flow blocking" will cause "instant" over-heat of the engine.

DETAILED DESCRIPTION OF THE INVENTION

It is therefore an essential object of the present invention to provide the boiling liquid cooling system with an improved parts-arrangement which is free of the drawbacks encountered in the above-mentioned prior proposed system.

Figure 2:
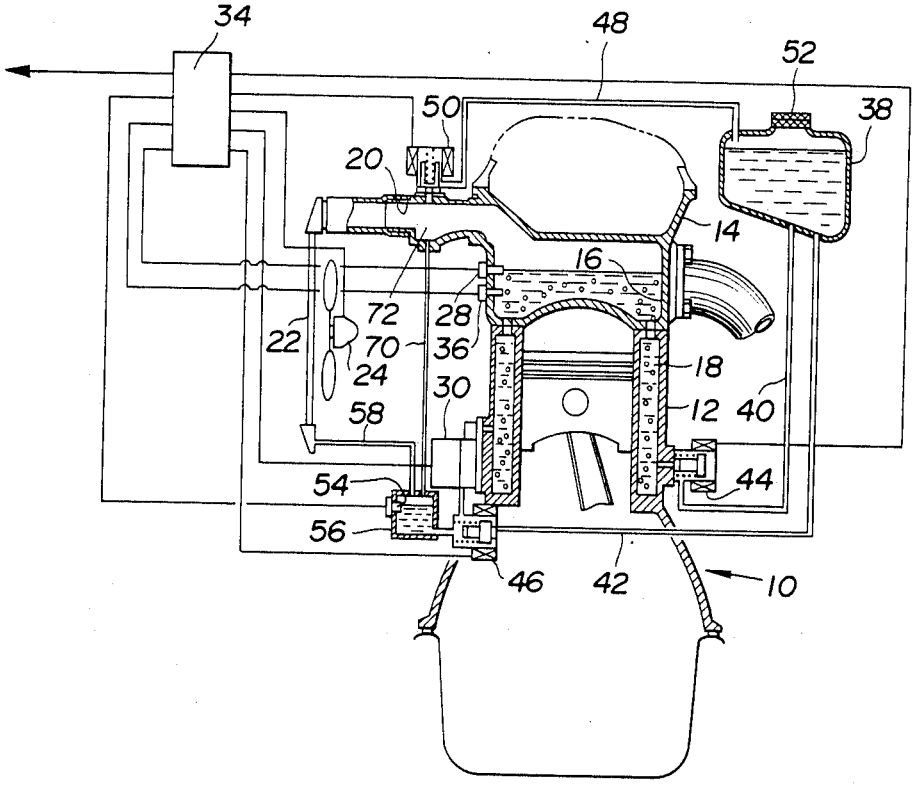
FIG. 2 is a view similar to FIG. 1, but showing an embodiment of the present invention.
Figure 3:
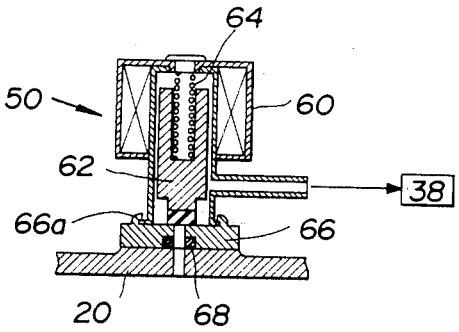
FIG. 3 is an enlarged sectional view of an electromagnetic valve employed in the invention.

Referring to FIGS. 2 and 3, particularly FIG. 2, there is shown an embodiment of the present invention which is practically applied to an internal combustion engine 10. For simplification, the parts identical to those in FIG. 1 are designated by the same numerals and detailed explanation of them is omitted from the following.

As is seen from the drawing (FIG. 2), unlike the system of FIG. 1, the radiator 22 is not provided with a lower tank integrated therewith. As a substitute for the lower tank, a separate small reservoir 56 is employed which is fluidly connected with the lower portion of the radiator 22 through a conduit 58. Thus, the coolant liquefied in the radiator 22 flows to the reservoir tank 56 through the conduit 58. The reservoir 56 is located close to the engine proper 10 in order to effectively absorb heat of the engine 10. It is thus desirable to mount the reservoir 56 directly on the outer wall of the cylinder block 12 of the engine. Similar to this, the electric pump 30 is located close to the engine proper 10, and more particularly, the pump 30 is directly connected to the outer wall of the engine, as shown. Furthermore, the three electromagnetic valves 44, 46 and 50 are positioned close to the engine proper 10, as shown. If possible, these valves 44, 46 and 50 are mounted directly to the walls of the engine for the same reasons as mentioned hereinabove. FIG. 3 shows in detail the arrangement wherein the electromagnetic valve 50 is mounted to the vapor discharge port 20 of the cylinder head 14 of the engine 10. The valve 50 comprises a case 60 in which an armature or valve body 62 is operatively disposed. The armature 62 is biased to assume its "CLOSED" position by a spring 64. The case 60 is mounted to the wall of the vapor discharge port 20 through a separate seat member 66 which is constructed of a high heat-conductive material such as copper. Although not shown in the drawing, a suitable retainer means is associated with the valve 50 to secure the same to the engine. The seat member 66 is formed with a raised stopper portion **66*a* to which the case 60 of the valve 50 is secured, as shown. Designated by numeral 68 is an O-ring which assures sealing at the associated portion. With this mounting arrangement, the heat transfer from the engine proper 10 to the valve assembly 50 is assuredly effected under operation of the engine. The other two valves 44 and 46 are mounted to the wall of the engine in substantially the same manner as that in the valve 50**.

Referring again to FIG. 2, in addition to the above-mentioned arrangement, a bypass conduit 70 is provided which extends between the vapor discharge port 20 of the cylinder head 14 and the small reservoir 56, by passing the radiator 22. The interior of the vapor discharge port 20 is recessed at the portion 72 to which the bypass conduit 70 is exposed, so that liquid coolant collected in the recess 72 flows down to the reservoir 56 through the conduit 70. Of course, this bypass conduit 70 is positioned close to the engine proper in order to effectively absorb heat from the engine.

In this embodiment, due to the location of the so-called "cold weather easily affected parts" (which are the reservoir 56, the electric pump 30, the three electric valves 44, 46 and 50 and the bypass conduit 70) being located close to the heat generator or the engine proper 10, normal operations of these parts are achieved within a shortened time after start of the engine even when the engine and the cooling system have been severely cooled with the coolant being in the "sherbet-like" state. That is, the freezed coolant in these parts is positively warmed by the engine proper 10, so that the coolant in the system as a whole melts quickly thereby quickly improving the movability of the coolant in the system. Thus, the normal operation of the cooling system is achieved in a short time after start of the engine under cold condition.

If, however, the freezed coolant in the radiator 22 does not melt quickly, the bypass passage 70 functions advantageously as follows. That is, under such condition, the coolant (even when it is in liquid state of gaseous state) in the coolant jacket 16 can flow through the bypass conduit 70 bypassing the blocked radiator 22, thereby, though imperfectly, carrying out operation of the cooling system. Thus, the abnormally high pressure in the system, which might otherwise occur, can be avoided. The freezed coolant in the radiator 22 melts gradually and finally settles the blocked condition in the radiator 22. After this, the normal operation of the cooling system takes place. Because the heat radiation at the radiator 22 is quite higher than that at the bypass conduit 70, the provision of the bypass conduit 70 hardly affects the calculated function of the cooling system.

As is understood from the above, in accordance with the present invention, the so-called "cold weather easily affected parts" are arranged close to the engine which is a heat generator. Thus, the normal operation of each part is achieved in a short time after start of the engine under cold condition. Furthermore, even when the blocking in the radiator 22 due to freezed coolant therein is not settled quickly, the circulation of the coolant in the system is carried out, though imperfectly, by the bypass conduit 70. Thus, the abnormally high pressure in the system, which might otherwise occur and cause over-heat of the engine, can be assuredly avoided in the present invention.

What is claimed is:

1. In a boiling liquid cooling system for an engine which generates heat when operated, an arrangement comprising:

means defining in the engine a coolant jacket into which coolant is introduced in liquid state through an inlet port formed in the engine and from which coolant is discharged in gaseous state through an outlet port formed in the engine;

a radiator into which gaseous coolant from said outlet port is introduced to be liquefied;

a separate coolant reservoir into which the liquefied coolant from the radiator is introduced;

an electric pump by which the liquid coolant in said reservoir is pumped to said coolant jacket through said inlet port of the coolant jacket;

a first conduit connecting said radiator, said separate coolant reservoir and said electric pump to form a coolant circulation circuit which extends between said inlet and outlet ports of the coolant jacket; and at least one electromagnetic valve associated with said coolant circulation circuit to control flow of the coolant in the circuit, wherein said separate coolant reservoir, said electric pump and said electromagnetic valve are positioned close to the engine proper so as to effectively absorb heat generated by the engine.

2. An arrangement as claimed in claim 1, in which said electromagnetic valve is connected to the engine proper through a high heat-conductive seat member.

3. An arrangement as claimed in claim 2, further comprising:

a reservoir tank in which additional liquid coolant is contained, said additional liquid coolant being used for filling the coolant jacket with the liquid coolant;

a second conduit extending between said reservoir tank and said electromagnetic valve;

a third conduit extending between said reservoir tank and another inlet port of said coolant jacket which is formed in the engine;

a fourth conduit extending between an upper portion of said reservoir tank and said outlet port of said coolant jacket; and two electromagnetic valves respectively associated with said third and fourth conduits to control flow of the coolant in these conduits, wherein said two electromagnetic valves are positioned close to the engine proper so as to effectively absorb heat generated by the engine.

4. An arrangement as claimed in claim 1, further comprising a bypass conduit which connects said outlet port of said coolant jacket to said separate coolant reservoir bypassing said radiator, said bypass conduit being positioned close to the engine proper to effectively absorb heat generated by the engine.

5. An arrangement as claimed in claim 4, in which the outlet port of said coolant jacket is recessed at the portion to which one end of said bypass conduit is exposed.

6. An arrangement as claimed in claim 5, further comprising:

a reservoir tank in which additional liquid coolant is contained, said additional liquid coolant being used for filling the coolant jacket with the liquid coolant;

a second conduit extending between said reservoir tank and said electromagnetic valve;

a third conduit extending between said reservoir tank and another inlet port of said coolant jacket which is formed in the engine;

a fourth conduit extending between an upper portion of said reservoir tank and said outlet port of said coolant jacket; and two electromagnetic valves respectively associated with said third and conduits to control flow of the coolant in these conduits, wherein said two electromagnetic valves are positioned close to the engine proper so as to effectively absorb heat generated by the engine.

* * * * *